US009500977B2

(12) United States Patent
Matsuzaki et al.

(10) Patent No.: US 9,500,977 B2
(45) Date of Patent: Nov. 22, 2016

(54) ROLLER MEMBER, ROLLER SUPPORTING MECHANISM, AND METALLIC SHAFT FOR FORMING AN IMAGE WITH A LASER

(71) Applicant: CANON KABUSHIKI KAISHA, Tokyo (JP)

(72) Inventors: Hiroomi Matsuzaki, Mishima (JP); Koji Yamaguchi, Numazu (JP); Kohki Kamata, Machida (JP); Motomi Suzuki, Kashiwa (JP); Yoshiyuki Beniya, Abiko (JP); Yukinori Nagata, Mishima (JP); Satoru Yamada, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/673,532

(22) Filed: Mar. 30, 2015

(65) Prior Publication Data

US 2015/0277265 A1 Oct. 1, 2015

(30) Foreign Application Priority Data

Mar. 31, 2014 (JP) ..... 2014-074541

(51) Int. Cl.
*G03G 15/00* (2006.01)
*G03G 15/02* (2006.01)
*G03G 15/08* (2006.01)

(52) U.S. Cl.
CPC ..... *G03G 15/0233* (2013.01); *G03G 15/0808* (2013.01); *G03G 15/0818* (2013.01)

(58) Field of Classification Search
CPC ..... G03G 15/1685; G03G 15/0233; G03G 15/0808; G03G 15/0818
USPC ..... 399/176; 492/30; 29/895.2
See application file for complete search history.

(56) References Cited

U.S. PATENT DOCUMENTS

| | | | | |
|---|---|---|---|---|
| 563,932 | A * | 7/1896 | Leavenworth et al. | B21C 37/09 138/171 |
| 1,450,935 | A * | 4/1923 | Anderson | 403/270 |
| 1,863,873 | A * | 6/1932 | Quarnstrom | 228/146 |

(Continued)

FOREIGN PATENT DOCUMENTS

| | | |
|---|---|---|
| JP | 2010-230748 A | 10/2010 |
| JP | 2013-109209 A | 6/2013 |

OTHER PUBLICATIONS

English Translation of Ono et al. Electrifying Roller, Image Forming Apparatus, and Image Forming Method, Oct. 14, 2010. Japanese Patent Office. JP2010-230748.*

*Primary Examiner* — David Gray
*Assistant Examiner* — Trevor J Bervik
(74) *Attorney, Agent, or Firm* — Canon U.S.A. Inc., IP Division

(57) ABSTRACT

A roller member used in an image forming apparatus including: a metallic shaft; and a covering layer, wherein the metallic shaft has a cylindrical shape formed so that one end portion and the other end portion of the metallic plate oppose each other, the one end portion and the other end portion each include a straight portion, a projection, and a depression, the projections on the one end portion engage the depressions on the other end portion, a straight area is located outside a projection and depression area in which the projection on the one end portion and the projection on the other end portion are aligned in an axial direction of the metallic shaft, and the projection and depression area is entirely covered with the covering layer and at least part of the straight area is exposed from the covering layer.

19 Claims, 14 Drawing Sheets

(56) References Cited

U.S. PATENT DOCUMENTS 5,974,972 A * 11/1999 Van Denend et al. ..... 101/375
7,632,180 B2 * 12/2009 Farley et al. ..... 460/66
8,333,388 B2 * 12/2012 Taft et al. ..... 279/2.17
8,714,086 B2 * 5/2014 Belfiore et al. ..... 101/401.1

* cited by examiner

ROLLER MEMBER, ROLLER SUPPORTING MECHANISM, AND METALLIC SHAFT FOR FORMING AN IMAGE WITH A LASER

BACKGROUND OF THE INVENTION

Field of the Invention

This disclosure relates to a roller member used for an image forming apparatus, a roller supporting mechanism provided with the roller member, and a metallic shaft used in the roller member. An image forming apparatus is an apparatus that forms images on recording media.

Examples of an image forming apparatus include, for example, electrophotographic copying machines using an electrophotographic image forming process, electrophotographic printers (LED printers, laser beam printers), facsimile apparatuses, and word processors.

Description of the Related Art

In the related art, an electrophotographic image forming apparatus (hereinafter, referred to as an image forming apparatus) includes a photosensitive member and a process device configured to act on the photosensitive member. Examples of the process device include a voltage application apparatus configured to apply electric charge on the photosensitive drum, a developing device configured to supply developer (hereinafter, referred to as "toner") to the photosensitive drum, and a cleaning device configured to clean toner failed to be transferred and remaining on a surface of the photosensitive drum.

Examples of a charging device in the voltage application apparatus include a roller charging system using a roller member. In the roller charging system, charging of the surface of the photosensitive drum is achieved by bringing a charging roller, which is a conductive resilient roller, into bias abutment with the photosensitive drum and applying a voltage thereto. The charging roller generally has a form having a resilient layer covering a metallic shaft over the entire area in a longitudinal direction other than both ends (Japanese Patent Laid-Open No. 2013-109209, pp. 11, FIG. 2).

Examples of the metallic shaft of the charging roller include a form using a cylindrical-shaped metallic shaft (Japanese Patent Laid-Open No. 2010-230748).

However, in the case of manufacturing the cylindrical-shaped metallic shaft by bending a metallic plate by a press work or the like, a mating portion (an opposed portion where one end portion and the other end portion of the metallic plate oppose each other) extending along an axial direction is present on the metallic shaft. In order to increase the strength of the metallic shaft at this time, a configuration in which a projection and depression area is provided on the mating portion and one end portion and the other end portion of the metallic plate are engaged by the projections and depressions of the metallic plate is conceivable. However, in this projection and depression area, if the metallic shaft is rotatably supported by the bearing portion, the bearing portion is caught by the projection and depression area, and hence a rotational sliding resistance may increase.

Therefore, reducing the resistance at the metallic shaft and the bearing portion at the time of rotation of the roller member while increasing the strength of the metallic shaft is required.

SUMMARY OF THE INVENTION

In view of such a problem in the related art, there is provided a roller member used in an image forming apparatus including: a metallic shaft; and a covering layer configured to cover the metallic shaft, wherein the metallic shaft has a cylindrical shape formed so that one end portion and the other end portion of the metallic plate oppose each other, the one end portion and the other end portion each include a straight portion, a projection, and a depression, the projection on the one end portion engages the depression on the other end portion, and the projection on the other end portion engages the depression on the one end portion in an opposing area in which the one end portion and the other end portion oppose each other, a straight area in which a straight portion on the one end portion and a straight portion on the other end portion oppose each other is located outside a projection and depression area in which the projection on the one end portion and the projection on the other end portion are aligned in an axial direction of the metallic shaft, and the projection and depression area is entirely covered with the covering layer and at least part of the straight area is exposed from the covering layer.

Further features of the present invention will become apparent from the following description of exemplary embodiments with reference to the attached drawings.

DESCRIPTION OF THE EMBODIMENTS

Example 1

An embodiment of this disclosure will be described with reference to the drawings in detail.

A direction of a rotational axis of an electrophotographic photosensitive drum is defined as a longitudinal direction.

In the longitudinal direction, a side where the electrophotographic photosensitive drum receives a driving force from an image forming apparatus body is defined as a driving side (on a drive force receiving portion 63*a* side in FIG. 6), and a side opposite thereto is defined as a non-driving side.

Figure 2:
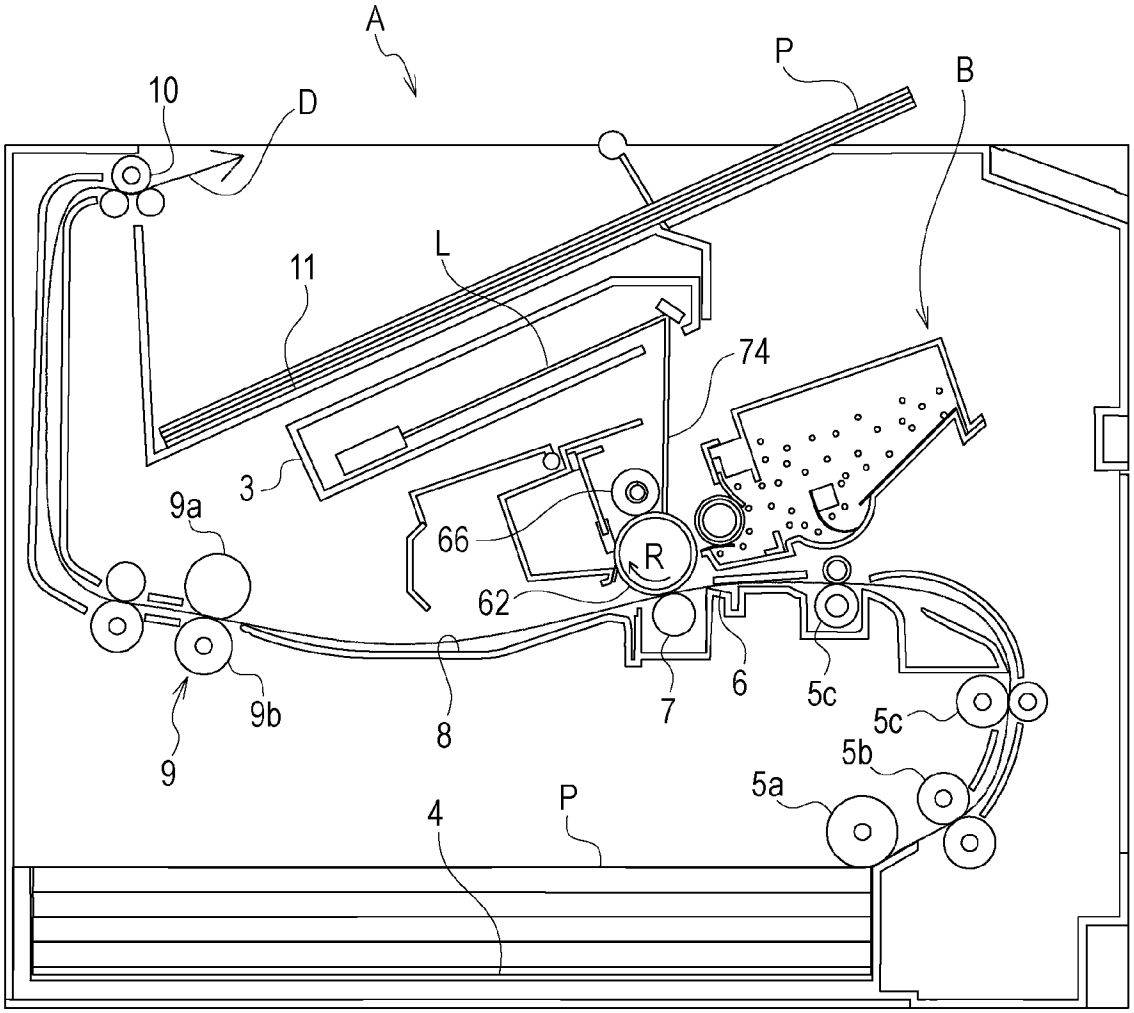
FIG. 2 is a cross-sectional view illustrating an image forming apparatus body and a process cartridge of an electrophotographic image forming apparatus of Example 1.
Figure 3:
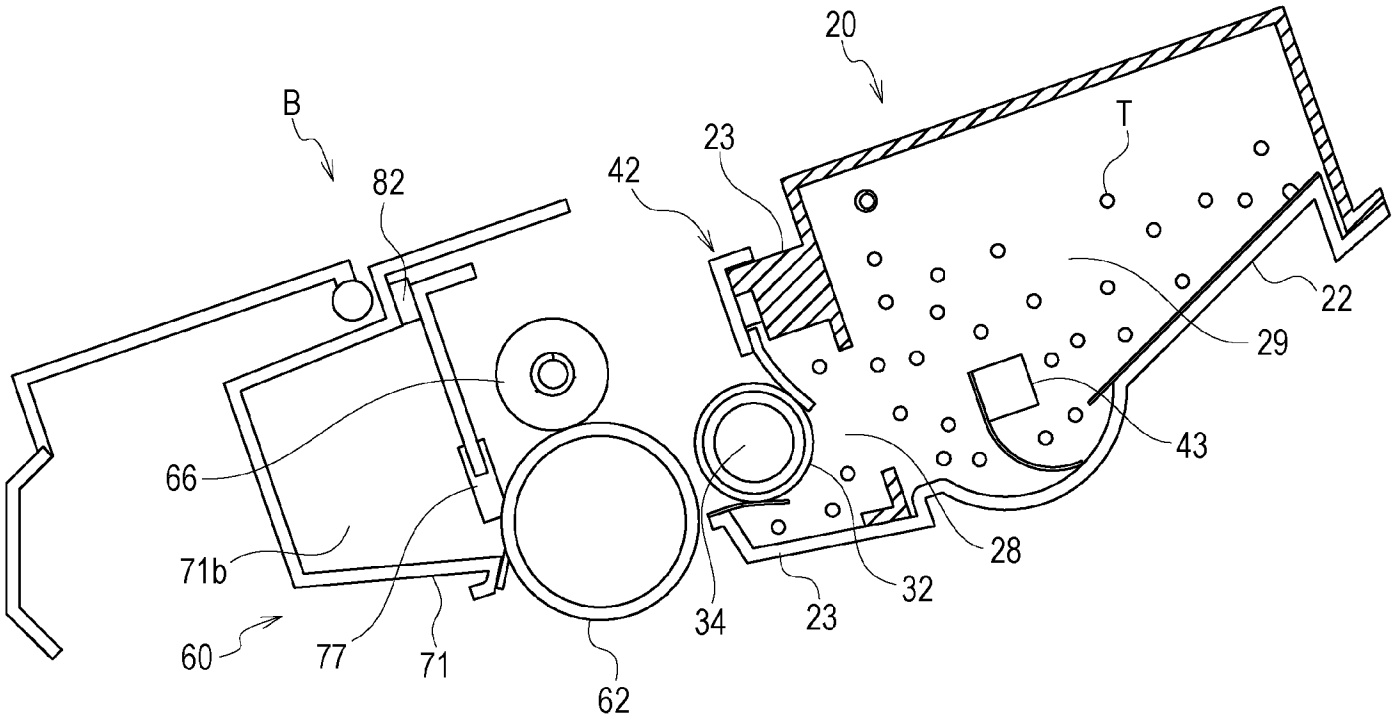
FIG. 3 is a cross-sectional view illustrating the process cartridge of Example 1.
Figure 4:
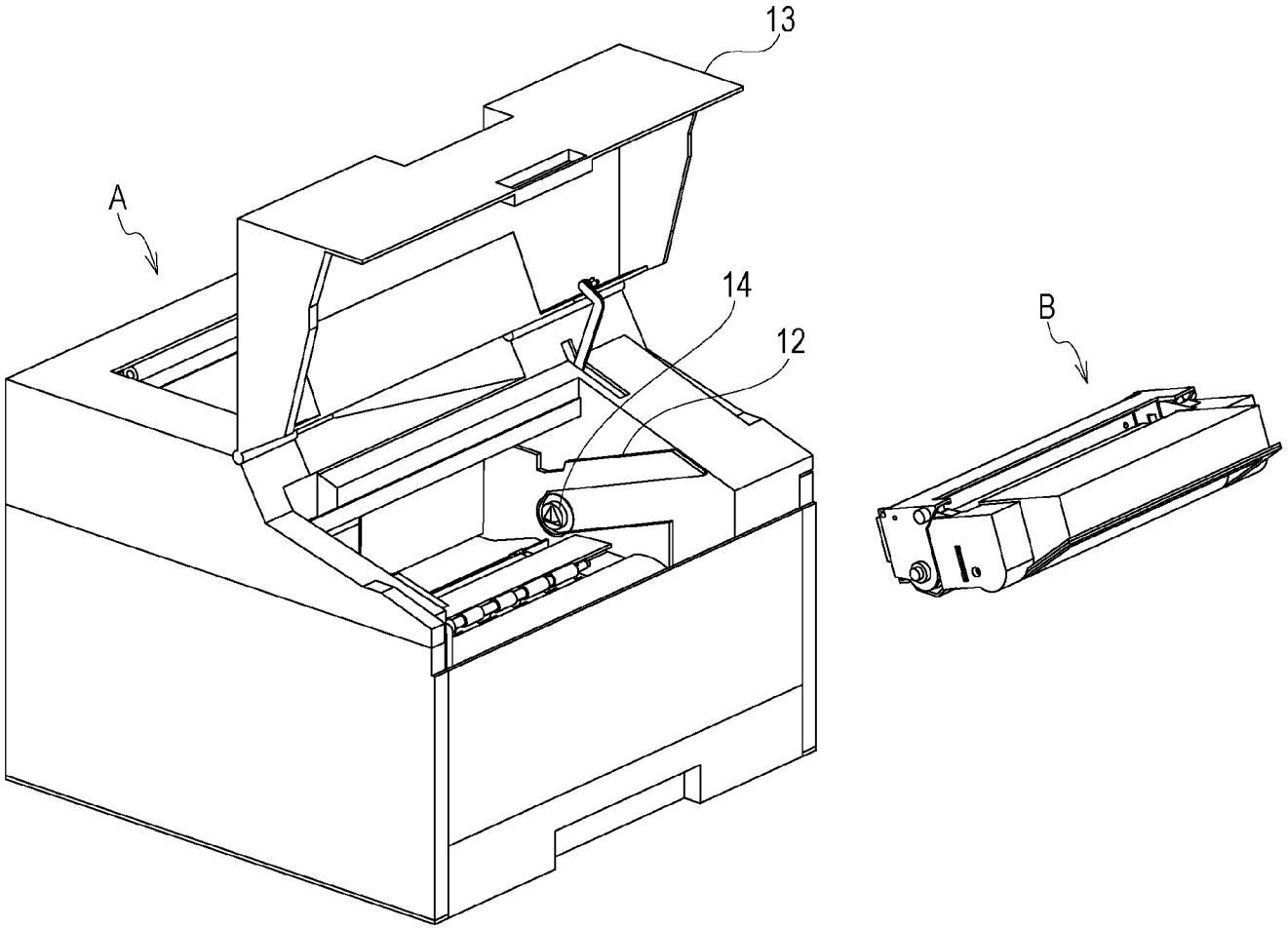
FIG. 4 is a perspective view illustrating the image forming apparatus body and the process cartridge in a state in which an opening and closing door of Example 1 is opened.

With reference to FIG. 2, FIG. 3, and FIG. 4, a general configuration and an image forming process will be described.

FIG. 2 is a cross-sectional view illustrating the image forming apparatus body (hereinafter, referred to as an apparatus body A) of the electrophotographic image forming apparatus and a process cartridge (hereinafter, referred to as a cartridge B) as an embodiment of this disclosure.

FIG. 3 is a cross-sectional view illustrating the cartridge B.

Here, the apparatus body A of the electrophotographic image forming apparatus is a portion of the electrophotographic image forming apparatus from which the cartridge B is removed.

FIG. 4 is a perspective view illustrating the image forming apparatus body A and the process cartridge B. General Configuration of Electrophotographic Image Forming Apparatus In FIG. 2 and FIG. 4, the electrophotographic image forming apparatus is a laser beam printer using an electrophotographic technology in which the cartridge B is demountably mounted on the apparatus body A. When the cartridge B is mounted on the apparatus body A, an exposure unit 3 (laser scanner unit) is arranged in an upper side of the cartridge B.

Also, a sheet tray 4 in which a recording medium (hereinafter, referred to as a sheet material P) which is a target of image formation is stored on a lower side of the cartridge B is arranged.

In addition, the apparatus body A includes a pickup roller 5*a*, a feed roller pair 5*b*, a conveyance roller pair 5*c*, a transfer guide 6, a transfer roller 7, a conveyance guide 8, a fixing unit 9, a discharging roller pair 10, and a discharge tray 11 arranged in sequence along a direction of conveyance of the sheet material P. The fixing unit 9 includes a heat roller 9*a* and a pressurizing roller 9*b*.

Image Forming Process

Subsequently, the image forming process is described schematically. On the basis of a print start signal, the electrophotographic photosensitive drum (hereinafter, referred to as a drum 62) is driven to rotate at a predetermined circumferential velocity (process speed) in a direction indicated by an arrow R.

A charging roller 66 to which a bias voltage is applied, comes into contact with an outer peripheral surface of the drum 62, and charges the outer peripheral surface of the drum 62 uniformly and evenly.

The exposure unit 3 outputs a laser beam L in accordance with image information. The laser beam L passes through an exposure window portion 74 on an upper surface of the cartridge B, and scans and exposes the outer peripheral surface of the drum 62.

Accordingly, an electrostatic latent image corresponding to the image information is formed on the outer peripheral surface of the drum 62.

In contrast, as illustrated in FIG. 3, in a developing assembly unit 20 as a developing assembly, toner T in a toner chamber 29 is stirred and conveyed by a rotation of a conveyance member 43 and fed to a toner supply chamber 28. The toner T is born on a surface of a developing roller 32 by a magnetic force of a magnet roller (fixed magnet). The toner T is controlled in layer thickness on a peripheral surface of the developing roller 32 while being charged by friction by a developing blade 42.

The toner T is transferred to the drum 62 in accordance with the electrostatic latent image, and is visualized as a toner image.

The drum 62 is an image bearing member configured to bear images (a toner image, a developer image) on the surface thereof. The developing roller 32 is a developer bearing member configured to bear developer (toner) for developing a latent image formed on the drum 62 as a toner image (developer image). As illustrated in FIG. 2, the sheet material P stored in a lower portion of the apparatus body A is fed from the sheet tray 4 by the pickup roller 5*a*, the feed roller pair 5*b*, and the conveyance roller pair 5*c* at the same timing as outputting of the laser beam L.

Then, the sheet material P passes through the transfer guide 6, and is fed to a transfer position between the drum 62 and the transfer roller 7. At this transfer position, the toner images are transferred in sequence from the drum 62 to the sheet material P.

The sheet material P to which the toner image is separated from the drum 62 and conveyed to the fixing unit 9 along the conveyance guide 8. The sheet material P then passes through a nip portion between the heat roller 9*a* and the pressurizing roller 9*b* which constitute part of the fixing unit 9.

At the nip portion, pressurization and heat-fixation are performed, so that the toner image is fixed to the sheet material P. The sheet material P subjected to the fixation of the toner image is conveyed to the discharging roller pair 10, and is discharged to the discharge tray 11.

In contrast, as illustrated in FIG. 3, residual toner on the outer peripheral surface of the drum 62 after the transfer is removed by a cleaning blade 77, and the drum 62 is used for the image forming process again. The toner removed from the drum 62 is stored in a waste toner chamber 71*b* of a cleaning unit 60.

In the above, the charging roller 66, the developing roller 32, and the cleaning blade 77 are process devices configured to act on the drum 62.

General Configuration of Cartridge

Subsequently, a general configuration of the cartridge B will be described with reference to FIG. 3 and FIG. 5.

Figure 5:
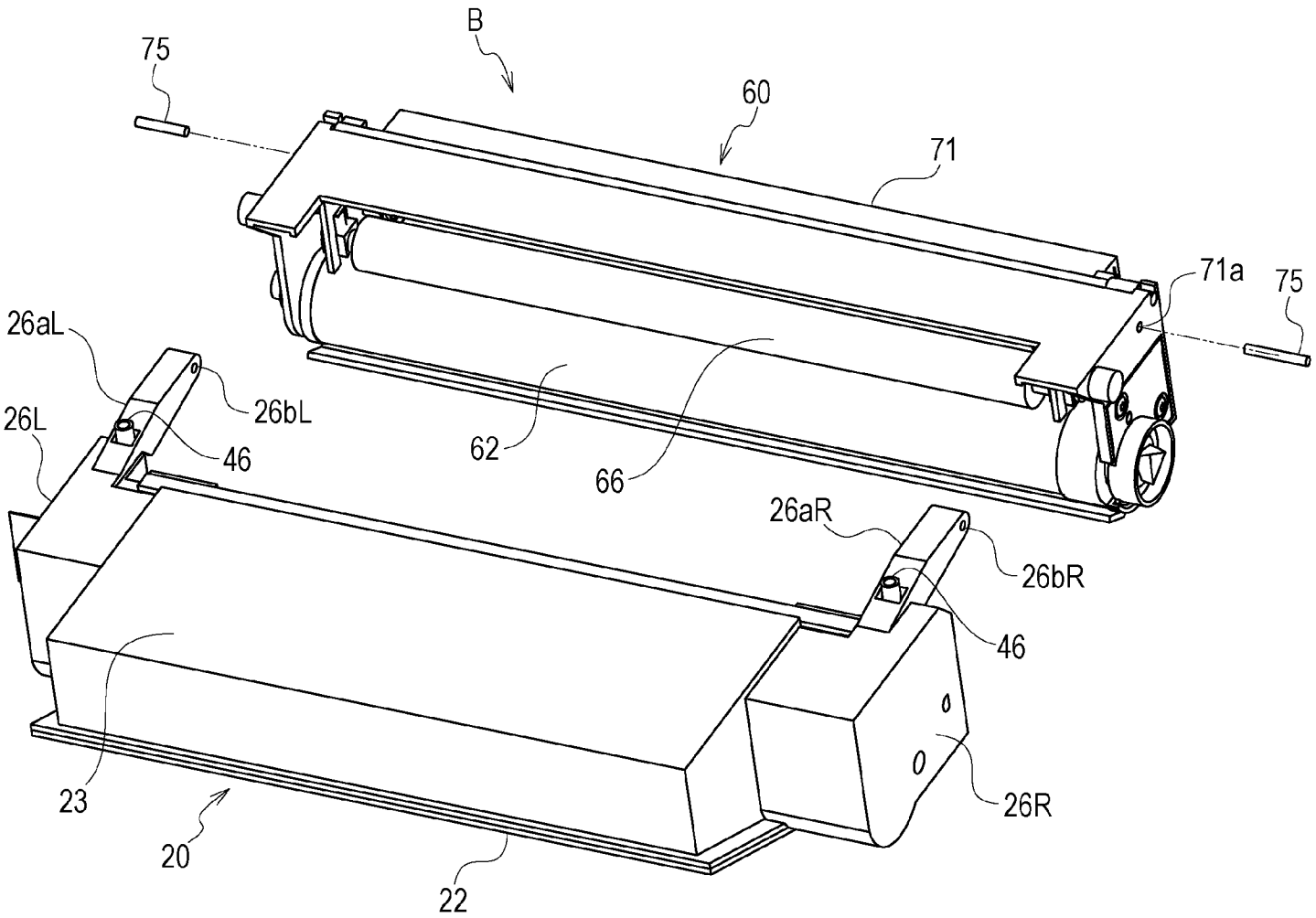
FIG. 5 is an explanatory perspective view illustrating a configuration of the process cartridge of Example 1.

FIG. 5 is an explanatory perspective view illustrating a configuration of the cartridge B.

The cartridge B includes the cleaning unit 60 and the developing assembly unit 20 combined with each other.

The cleaning unit 60 includes a cleaning frame member 71, the drum 62, the charging roller 66, and the cleaning blade 77.

In contrast, the developing assembly unit 20 includes a bottom member 22, a developer container 23, a first side member 26L, a second side member 26R, the developing blade 42, the developing roller 32, the magnet roller 34, the conveyance member 43, the toner T, and biasing members 46.

The cartridge B is formed by coupling the cleaning unit 60 and the developing assembly unit 20 with a coupling member 75 so as to be rotatable with each other.

Specifically, rotary hole 26*b*L and 26*b*R, extending in parallel with the developing roller 32, are formed at distal ends of arm portion 26*a*L and 26*a*R formed on the first side member 26L and the second side member 26R provided on the developing assembly unit 20 at both end portions thereof in a longitudinal direction (an axial direction of the developing roller 32).

Fitting holes 71*a* for fitting coupling members 75 are formed at both end portions of the cleaning frame member 71 in the longitudinal direction.

The arm portion 26*a*L and 26*a*R are aligned with predetermined positions of the cleaning frame member 71 to insert the coupling member 75 into the rotary holes 26*b*L and 26*b*R and the fitting hole 71*a*. Accordingly, the cleaning unit 60 and the developing assembly unit 20 are coupled so as to be rotatable about the coupling member 75 as a center.

At this time, the biasing members 46 mounted at roots of the arm portions 26*a*L and 26*a*R abut against the cleaning frame member 71, thereby biasing the developing assembly unit 20 toward the cleaning unit 60 about the coupling members 75 as a center of rotation.

Accordingly, the developing roller 32 is reliably pressed in the direction of the drum 62.

With distance retaining members (which are not illustrated) mounted on both end portions of the developing roller 32, the developing roller 32 is retained at a predetermined distance from the drum 62.

Configuration of Cleaning Unit

Subsequently, a configuration of the cleaning unit 60 will be described with reference to FIG. 6, FIGS. 7A and 7B, and FIG. 8.

Figure 6:
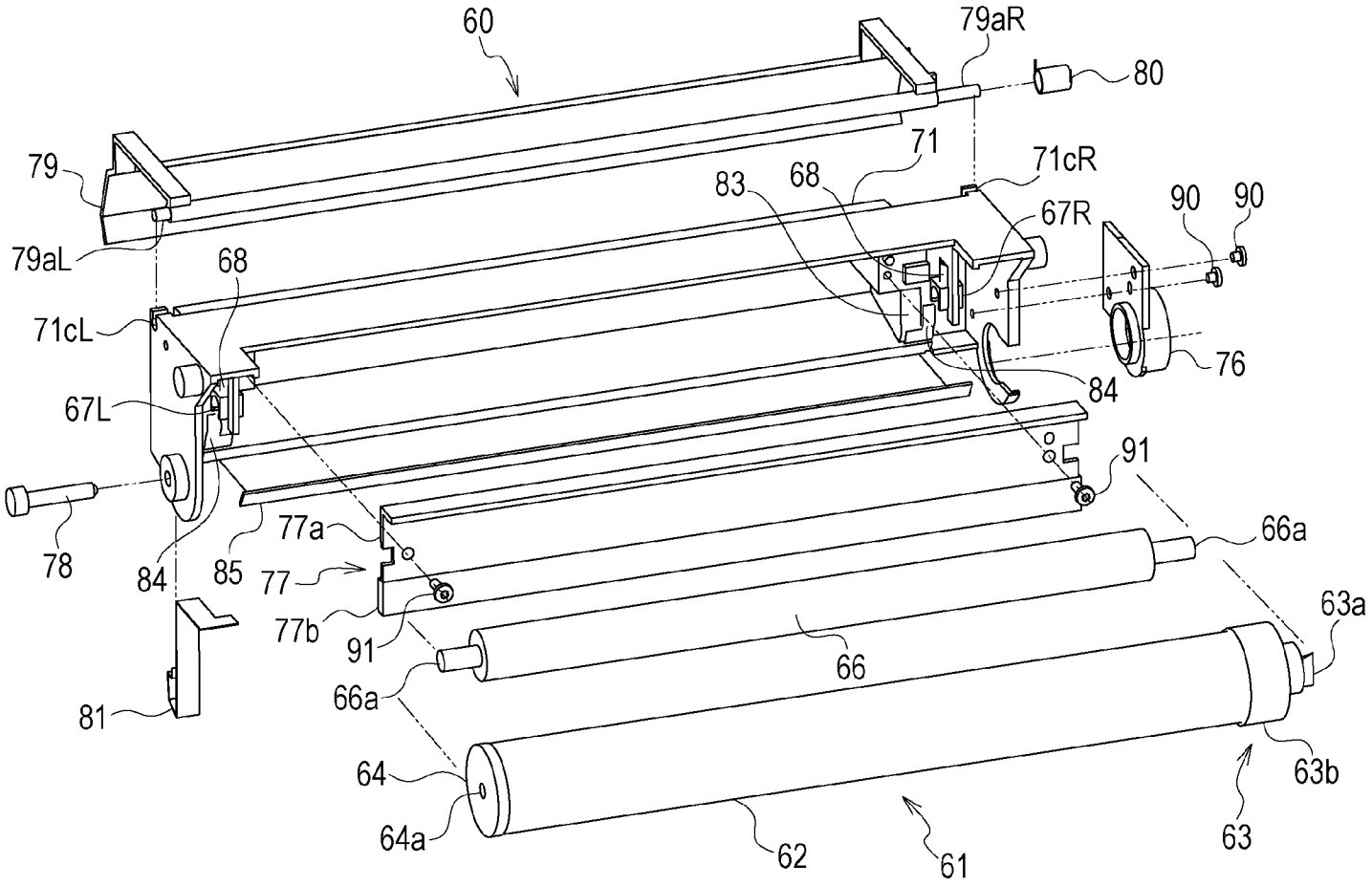
FIG. 6 is an explanatory perspective view illustrating a configuration of a cleaning unit of Example 1.

FIG. 6 is an explanatory perspective view illustrating the configuration of the cleaning unit 60.

Figure 7A:
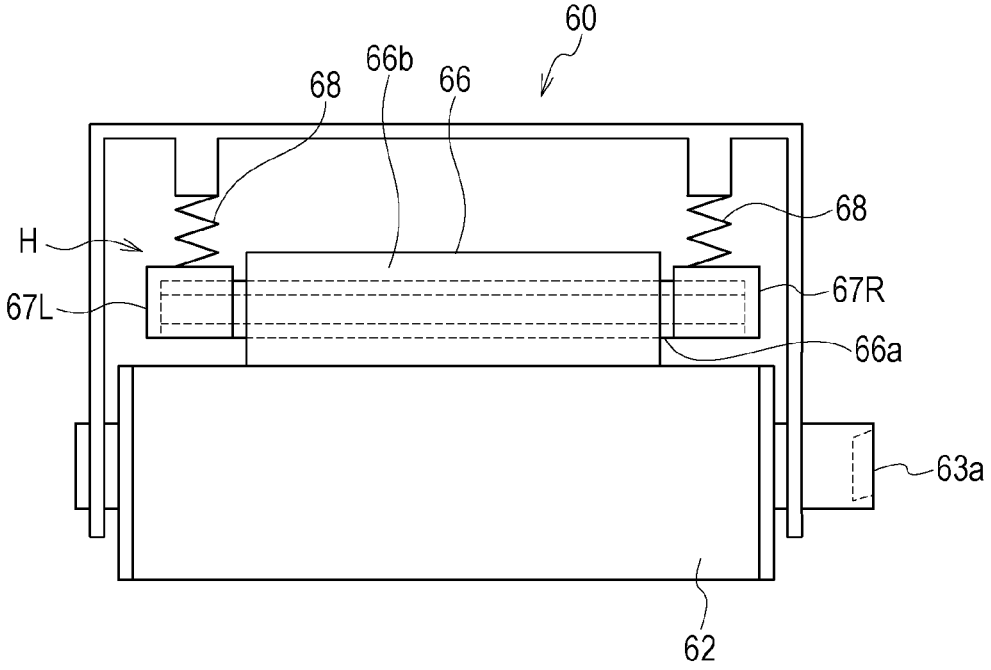
FIGS. 7A and 7B are explanatory perspective views illustrating the configuration of the cleaning unit of Example 1.
Figure 7B:
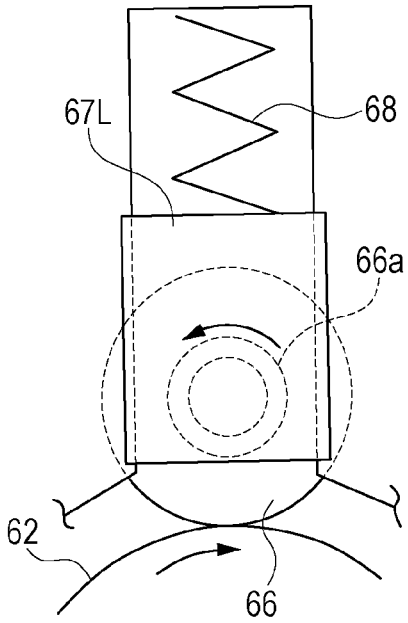
Figure 8:
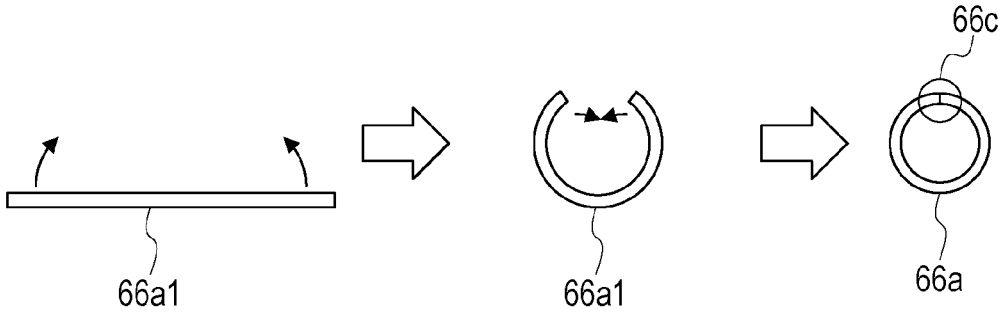
FIG. 8 is an explanatory cross-sectional view of a processing process of a charging roller of Example 1.

FIG. 7A is an explanatory front view illustrating the configuration of the cleaning unit 60. FIG. 7B is a drawing illustrating a supporting portion of the charging roller 66 viewed in a direction indicated by an arrow H. FIG. 8 is a cross-sectional view illustrating a process of formation of a shaft portion 66*a* from a plate into a cylindrical shape.

The cleaning blade 77 includes a supporting member 77*a* formed of a plate and a resilient member 77*b* formed of a resilient material such as urethane rubber, and is arranged at a predetermined position in the cleaning frame member 71 by fixing both ends of the supporting member 77*a* with screws 91.

Resilient member 77*b* comes into abutment with the drum 62, and removes residual toner from the outer peripheral surface of the drum 62.

The removed toner is stored in a waste toner chamber 71*b* (FIG. 3) of the cleaning unit 60.

A first seal member 82, a second seal member 83, a third seal member 84, and a fourth seal member 85 are fixed to predetermined positions of the cleaning frame member 71 with double-sided tape and the like.

The first seal member 82 is provided across the longitudinal direction and prevents wasted toner from leaking from a back side of the supporting member 77*a* of the cleaning blade 77.

The second seal member 83 prevents wasted toner from leaking from both ends of the resilient member 77*b* of the cleaning blade 77 in the longitudinal direction.

The third seal member 84 wipes adhered substances such as toner on the drum 62 while preventing the wasted toner from leaking out from the both ends of the resilient member 77*b* of the cleaning blade 77 in the longitudinal direction.

The fourth seal member 85 is provided in contact with the drum 62 across the longitudinal direction, and prevents the wasted toner from leaking out from the upstream side of the drum 62 in a direction of rotation with respect to the cleaning blade 77.

An electrode plate 81, a biasing member 68, and charging roller bearings (bearing portions) 67L and 67R are mounted on the cleaning frame member 71.

A metallic shaft (hereinafter, referred to as the shaft portion 66*a*) of the charging roller 66 is fitted to the charging roller bearings 67L and 67R. The charging roller 66 is biased by the biasing member 68 with respect to the drum 62, and is rotatably supported by the charging roller bearings 67L and 67R. The biasing member 68 is driven to rotate in association with the rotation of the drum 62. In other words, the charging roller 66 is supported by the cleaning unit 60 via charging roller bearings 67 (67L and 67R). The cleaning unit 60 is a roller supporting mechanism configured to support the charging roller 60.

The charging roller 66 is configured by covering the hollow shaft portion 66*a* with a conductive resilient layer 66*b* over the entire area in the longitudinal direction except for both ends. The shaft portion 66*a* is a cylindrical-shaped metallic shaft.

The resilient layer 66*b* and the shaft portion 66*a* are joined by an adhesive agent. The shaft portion 66*a* is a member formed a conductive metallic plate such as a stainless steel plate or a galvanized steel plate into a cylindrical shape by a press work. Here, using the hollow shaft portion 66*a* formed by a press work is used is to achieve a weight reduction of the charging roller 66, the cartridge having the charging roller 66, and the image forming apparatus by reducing the weight of the shaft portion 66*a*. If the shaft portion 66*a* can be formed by processing the metallic plate, a cost reduction of the shaft portion 66*a* is achieved.

The electrode plate 81, the biasing member 68, the charging roller bearing 67L, and the shaft portion 66*a* have conductivity. The electrode plate 81 is in contact with a power feeding portion (which is not illustrated) of the apparatus body A. With these members using as a power feeding route, power is supplied to the charging roller 66.

The drum 62 is coupled integrally with a flange 64 and a flange 63 to achieve an electrophotographic photosensitive drum unit (hereinafter, referred to as a drum unit 61). This coupling method uses caulking, adhesion, welding, and the like.

An earth contact point and the like (which is not illustrated) is coupled to the flange 64. The flange 63 includes a drive force receiving portion 63*a* configured to receive a drive force from the apparatus body A and a flange gear portion 63*b* configured to transmit the drive force to the developing roller 32.

A bearing member 76 is integrally fixed to a driving side of the cleaning frame member 71 with a screw 90, and a drum shaft 78 is fixed to a non-driving side of the cleaning frame member 71 by press fitting.

The bearing member 76 fits the flange 63, and the drum shaft 78 fits a hole 64*a* of the flange 64.

Accordingly, the drum unit 61 is rotatably supported by the cleaning frame member 71.

A protecting member 79 is rotatably supported by the cleaning frame member 71 so that a protection (light-shielding) of the drum 62 and exposure are allowed.

A biasing member 80 is mounted on a shaft portion 79*a*R on a driving side of the protecting member 79, and biases the protecting member 79 in a direction to protect the drum 62.

A shaft portion 79*a*L on a non-driving side and the shaft portion 79*a*R on the driving side of the protecting member 79 fit bearing portions 71*c*L and 71*c*R of the cleaning frame member 71.

Configuration of Charging Roller 66

A configuration of the charging roller 66 will be described with reference to FIG. 1, FIG. 8, FIGS. 9A and 9B, FIG. 10, FIGS. 11A and 11B, and FIG. 14A.

Figure 1:
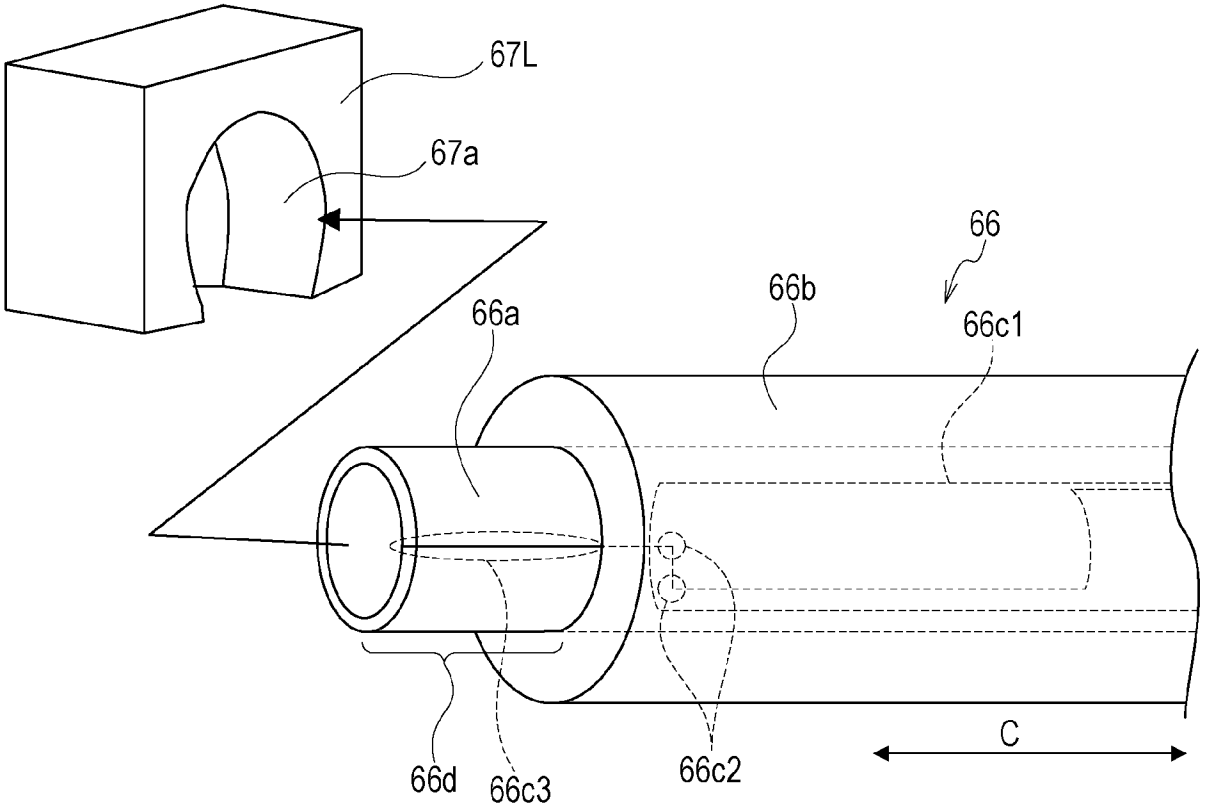
FIG. 1 is a perspective view illustrating a charging roller of Example 1.
Figure 9A:
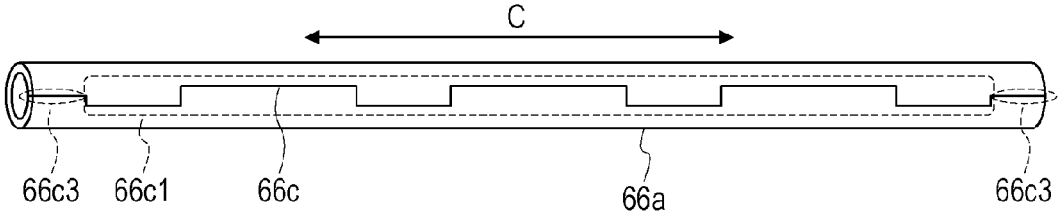
FIGS. 9A and 9B are an explanatory perspective views illustrating a shaft portion of the charging roller of Example 1.
Figure 9B:
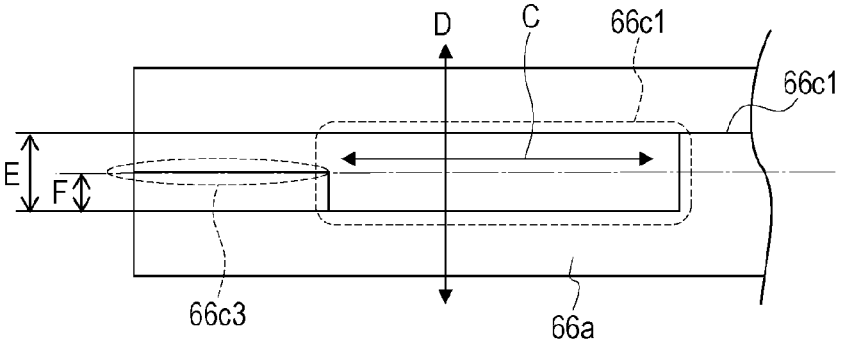
Figure 10:
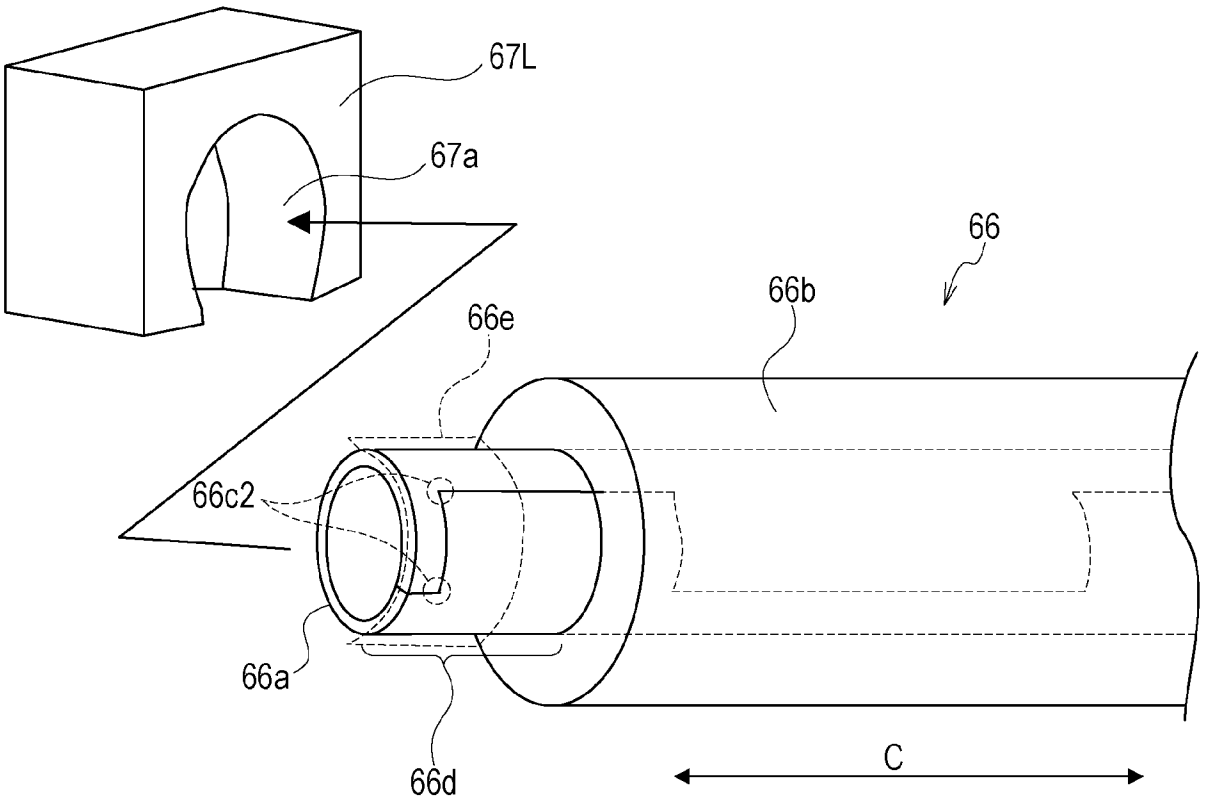
FIG. 10 is an explanatory view illustrating the charging roller.
Figure 11A:
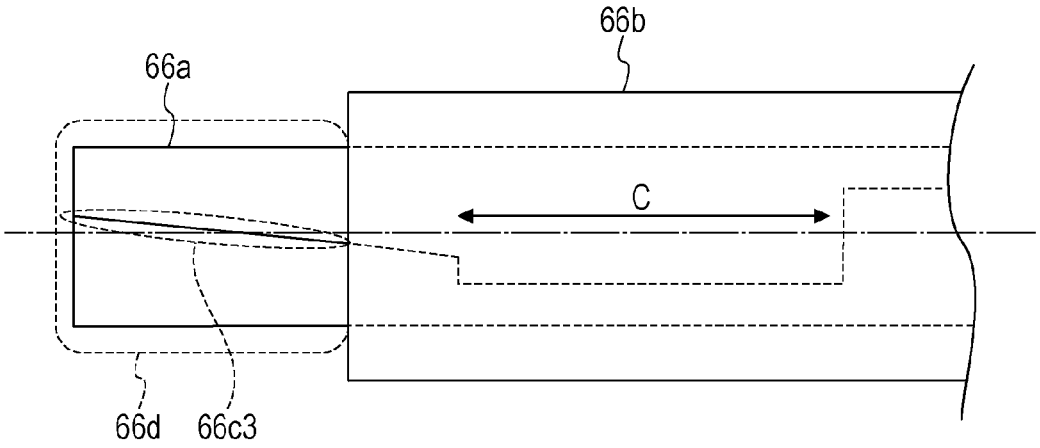
FIGS. 11A and 11B are explanatory views illustrating the charging roller of Example 1.
Figure 11B:
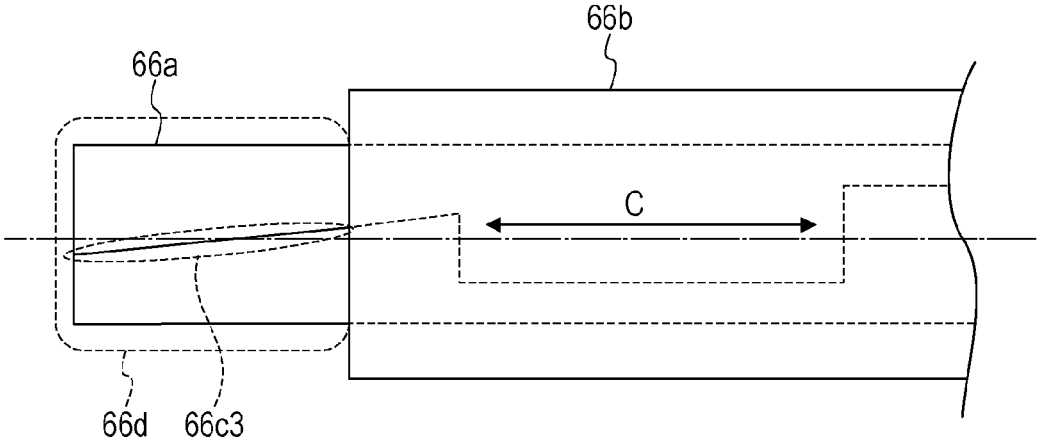
Figure 14A:
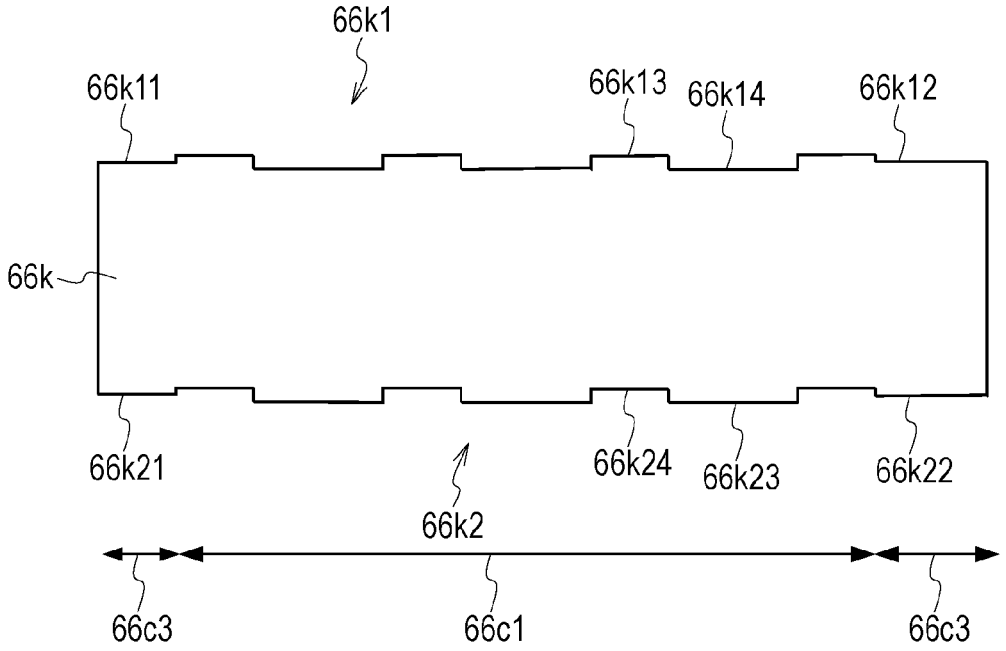
FIG. 14A is an explanatory view illustrating the metallic plate.

FIG. 1 is a perspective view illustrating the charging roller 66 and the charging roller bearing 67L. FIG. 9A is a perspective view illustrating a shaft portion 66*a*. FIG. 9B is a detailed drawing illustrating an end portion 66*d* of the shaft portion 66*a* of the charging roller 66. FIG. 10 is a perspective view illustrating the charging roller 66 and the charging roller bearing 67L in which this disclosure is not implemented. FIGS. 11A and 11B are detailed drawings illustrating the end portion 66*d* of the shaft portion 66*a* of the charging roller 66. FIG. 14A is an explanatory view illustrating the metallic plate.

The shaft portion 66*a* of the charging roller 66 as illustrated in FIG. 8 is a member formed by shaping into a cylindrical shape in outer diameter by pressing a conductive metallic plate 66*a*1. A mating portion (an opposing area of end portions of the metallic plate) 66*c* of the metallic plate extending along an axial direction C of the shaft portion 66*a* is formed.

Here, in this example, an outer diameter of the shaft portion 66 is ϕ6 mm, the entire length in the axial direction C is 252.5 mm. An outer diameter and the entire length required in terms of function may be selected as needed.

With the provision of a plurality of projection and depression portions 66*c*1 on the mating portion 66*c*, a desired strength is provided on the shaft portion 66*a*. The larger the number of depressions and projections, the stronger the shaft portion becomes, which is preferable. However, the strength required in terms of the function of the product may be selected as needed.

FIG. 14A illustrates a metallic plate 66*k* before a press work. The metallic plate 66*k* includes straight portions 66*k*11 and 66*k*12, a plurality of projections 66*k*13, and a plurality of depressions 66*k*14 on one end portion (a first end portion) 66*k*1. The metallic plate 66*k* also includes straight portions 66*k*21 and 66*k*22, a plurality of projections 66*k*23, and a plurality of depressions 66*k*24 on the other end portion (a second end portion) 66*k*2. When the metallic plate 66*k* is bent so that the one end portion 66*k*1 and the other end portion 66*k*2 oppose each other by the press work, a cylindrical-shaped shaft portion 66*a* is formed.

Here, the mating portion 66*c* has the projection and depression portion 66*c*1 including the plurality of depressions and projections and two straight areas 66*c*3 as illustrated in FIG. 9A and FIG. 9B. The straight areas 66*c*3 are provided on both end sides in the axial direction C, and the projection and depression area 66*c*1 is provided between the two straight portions 66*c*3. The two straight areas 66*c*3 are arranged outside in the axial direction of the metallic shaft 66*a* than the projection and depression area 66*c*1.

As is understood by comparing FIG. 14A and FIG. 9A, as a result that the metallic plate 66*k* is bent, the opposing area in which the one end portion 66*k*1 and the other end portion 66*k*2 oppose each other corresponds to the mating portion 66*c* of the metallic shaft 66*a*.

In particular, an opposing area in which the straight portion 66*k*11 provided on the one end portion 66*k*1 and the straight portion 66*k*21 provided on the other end portion 66*k*2 of the metallic plate 66*k* oppose each other corresponds to the straight areas 66*c*3 of the mating portion 66*c*.

In the same manner, an opposing area in which the straight portion 66*k*12 provided on the one end portion 66*k*1 and the straight portion 66*k*22 provided on the other end portion 66*k*2 of the metallic plate 66*k* oppose each other corresponds to the straight areas 66*c*3 of the mating portion 66*c*.

The projections 66*k*13 provided on the one end portion 66*k*1 of the metallic plate 66*k* engage the depressions 66*k*24 provided on the other end portion 66*k*2, respectively. In the same manner, the projections 66*k*23 provided on the other end portion 66*k*2 engage the depressions 66*k*14 provided on the one end portion 66*k*1, respectively.

The projections 66*k*13, the depressions 66*k*24, the projections 66*k*23, and the depressions 66*k*14 provided on the metallic plate 66*k* form the projections and depressions of the projection and depression area 66*c*1 on the mating portion 66*c* of the metallic shaft 66*a*. More specifically, the projection and depression area 66*c*1 provided on the mating portion 66*c* is an area in which a plurality of the projections 66*k*13 provided on the one end portion 66*k*1 of the metallic plate 66*k* and a plurality of the projections 66*k*23 provided on the other end portion 66*k*2 are formed so as to be arranged alternately.

As illustrated in FIG. 9B, in a vertical direction D with respect to the axial direction C of the shaft portion 66*a*, a relationship between a projecting amount (=depressing amount) E of the projection and depression portion 66*c*1 of the mating portion 66*c* and a projecting amount F of the straight portion 66*c*3 is E>F.

In this example, the value E of the shaft portion is 2 mm, and the value F is 1 mm, which is half the value E. However, a desired value may be selected as the value E within a range from 1 to 3 mm.

Subsequently, an arrangement relationship between the shaft portion 66*a* and the resilient layer 66*b* will be described. By covering the projection and depression portion 66*c*1 with the resilient layer (covering layer) 66*b*, corner portions 66*c*2 of the projection and depression area 66*c*1 (recessed corners of the depressions and projecting corners of the projections, or portions where these recessed corners and projecting corners engage) are covered entirely with the resilient layer 66*b* as illustrated in FIG. 1. With this arrangement, the corner portions 66*c*2 are not exposed to the end portions (exposed portion) 66*d* of the shaft portions 66*a* which are not covered with the resilient layer 66*b*. Therefore, sliding portions 67*a* of the bearings 67L and 67R which come into sliding contact (contact) with the shaft portion 66*a* and the corner portions 66*c*2 do not overlap with each other.

In contrast, at least part of the straight areas 66*c*3 is exposed from the resilient layer 66*b*. In other words, in a contact portion of the shaft portion 66*a* which comes into contact with the bearings 67L and 67R, the mating portion 66*c* are entirely formed of the straight areas 66*c*3. The contact portion of the shaft portion 66*a* that comes into contact with the charging roller bearings 67L and 67R do not have the projection and depression area 66*c*1.

The straight areas 66*c*3 can hardly be caught by the charging roller bearings 67L and 67R at the time of rotation of the charging roller, and a sliding resistance between the charging roller and the charging roller bearings 67L and 67R becomes small.

In contrast, as an example in which this disclosure is not implemented, the case where the corner portions 66*c*2 of the projection and depression area 66*c*1 is exposed to the end portion 66*d*, and the sliding portion 67*a* of the bearing 67L (a slid portion on the 66*a* side is 66*e*) and the corner portions 66*c*2 overlap with each other is illustrated in FIG. 10. At this time, the bearing 67L receives a sliding resistance due to a minute gap or level difference of the corner portions 66*c*2. The sliding resistance impairs the rotation of the charging roller and causes an image failure.

With the configuration described thus far, by preventing the corner portions 66*c*2 from overlapping with the sliding portion 67*a* of the bearing, an occurrence of the image failure can be restrained.

In FIG. 1, the mating portion 66*c* (that is, the straight area 66*c*3) extends in a direction parallel to the axial direction C of the shaft portion 66*a* in the end portion 66*d* of the shaft portion 66*a*. However, as the mating portion 66*d* illustrated in FIG. 11, the straight area which does not extend in parallel to the axial direction C of the shaft portion 66*a* is also applicable.

A configuration having no gap in engagement of the depressions and the projections at the projection and depression area 66*c*1 of the mating portion 66*c* is preferable in terms of strength. However, a gap may be generated in part of engagement between the depressions and the projections.

In the description given above, the charging roller 66 is exemplified as the roller member to be employed in this example. However, in the image forming apparatus, the roller member which employs the configuration of this example is not limited to the charging roller and, for example, the developing roller 32 is also applicable.

The charging roller 66 and the developing roller are conductive rollers (having an electric resistance of $10^8\Omega$ or lower), and are applied with a voltage at the time of image formation. However, the roller members are not limited thereto. The roller members to which the voltage is not applied at the time of image formation are also applicable, and a roller member covered with an insulative resilient member on an outer periphery of the metallic shaft 66*a*.

Example 2

Figure 12A:
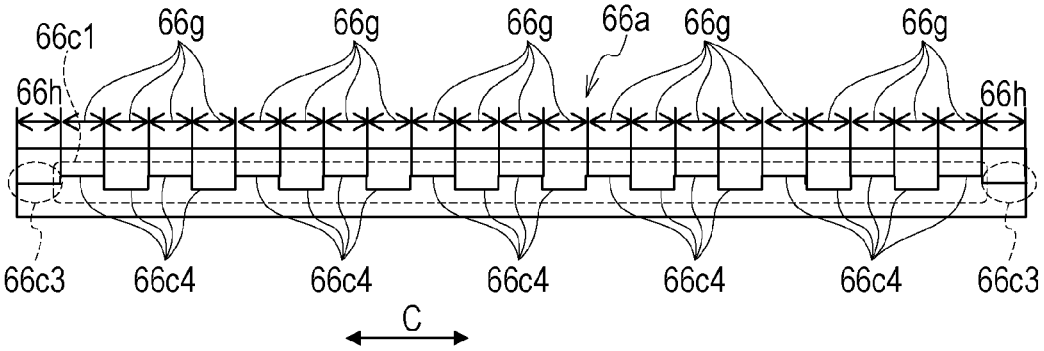
FIGS. 12A and 12B are explanatory perspective views illustrating a charging roller of Example 2.
Figure 12B:
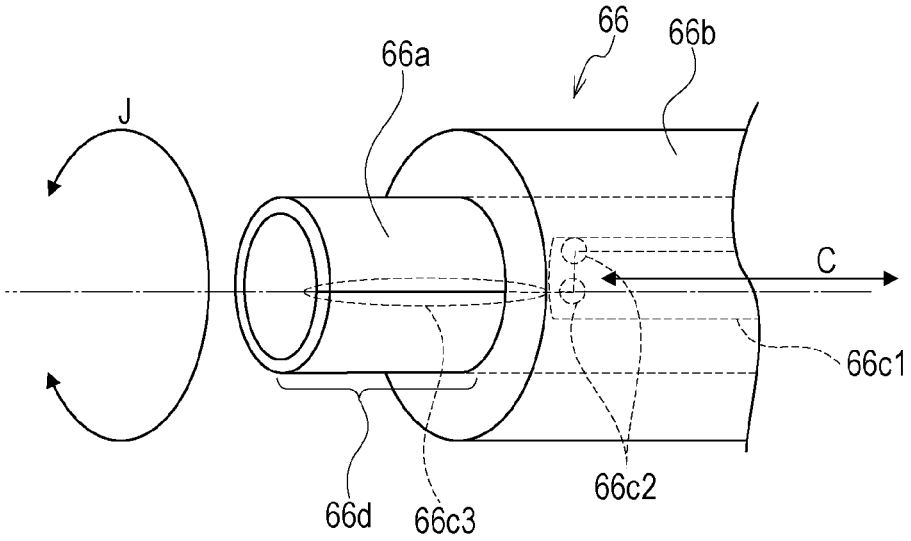

Referring now to FIGS. 12A and 12B, a configuration of Example 2 will be described.

FIG. 12A is an explanatory view illustrating the shaft portion 66*a*. FIG. 12B is a detailed drawing illustrating the end portion of the charging roller 66. Example 2 is the same as Example 1 in those other than the arrangement of the projection and depression portion 66*c*1 of the mating portion in the axial direction C of the charging roller 66 and the dimensional relationship of a width 66*g*.

Figure 14B:
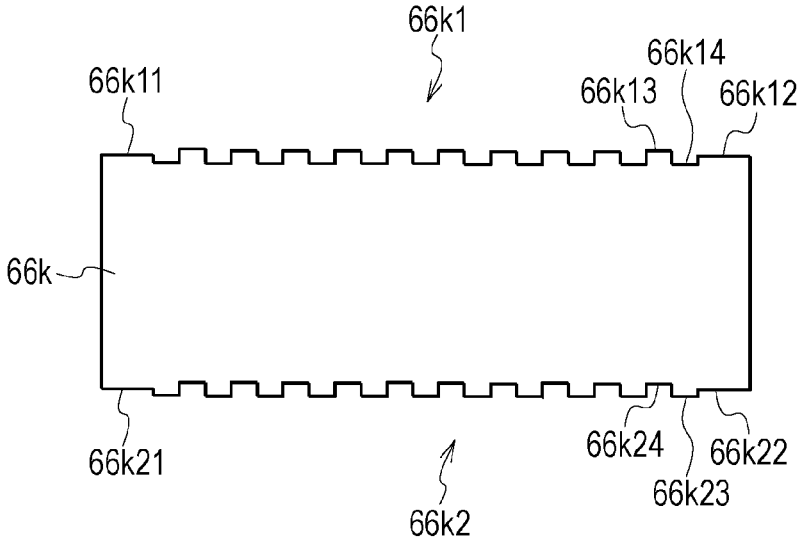
FIG. 14B is an explanatory view illustrating the metallic plate.

Here, a width 66*f* (a width in the axial direction) of each of the projection and depression portion 66*c*4 of the projection and depression area 66*c*1 at the mating portion in the axial direction C of the charging roller 66 are set to be the same, so that the projection and depression portion 66*c*4 are arranged equidistantly. In other words, all the widths in the axial direction in the projections 66*k*13 on the one end portion and the projections 66*k*23 on the other end portion are equal as the metallic plate 66*k* illustrated in FIG. 14B.

In this manner, by equalizing the width 66*f*, the same strength is achieved irrespective of the direction of twisting of the shaft portion 66*a* in a direction indicated by an arrow J. Accordingly, the direction of the axial direction C of the shaft does not need to be selected to use, the process of selecting the direction of the shaft is eliminated at the time of assembly, so that the cost may be reduced.

Although a configuration having no gap in engagement of the projections and depressions at the mating portion is preferable in terms of strength, a gap may be partly generated.

Example 3

Figure 13A:
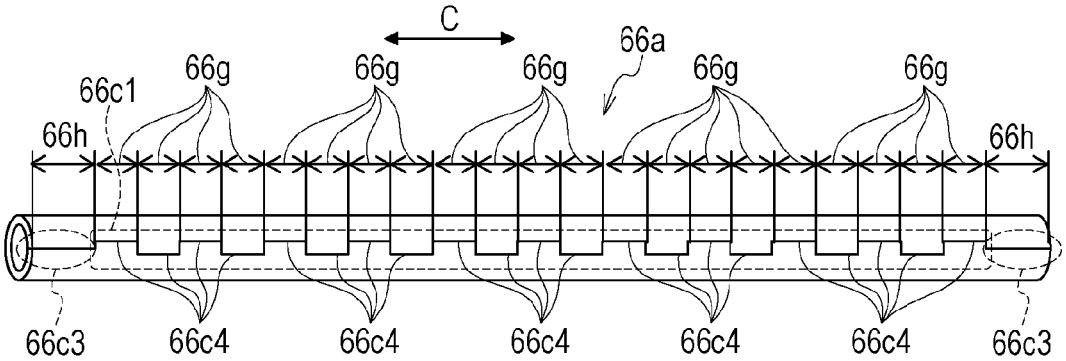
FIGS. 13A to 13C are explanatory views illustrating a charging roller of Example 3.
Figure 13B:
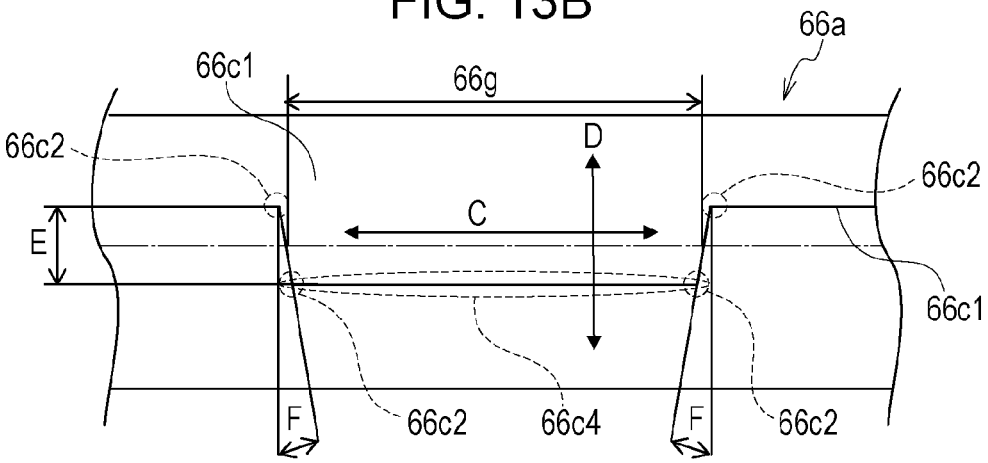
Figure 13C:
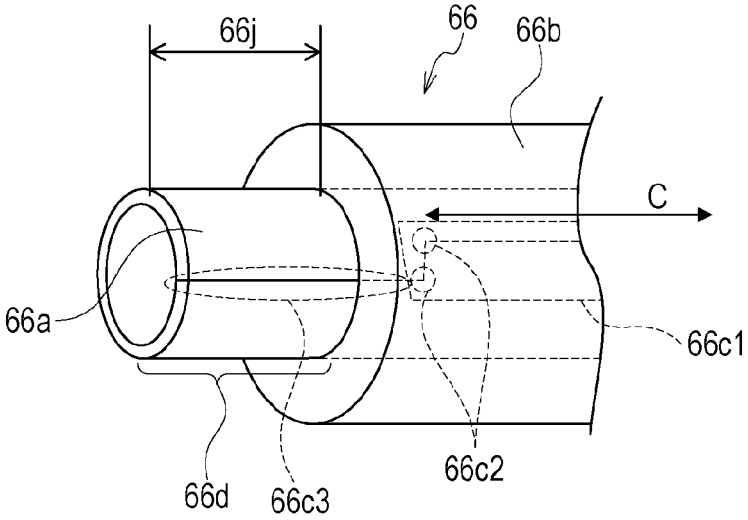

Referring now to FIGS. 13A to 13C, a configuration of Example 3 will be described. FIG. 13A is an explanatory view illustrating the shaft portion 66*a*. FIG. 13B is an explanatory view illustrating the projection and depression portion 66*c*1. FIG. 13C is a detailed drawing illustrating an end portion of the charging roller 66.

Example 3 is the same as Example 2 in those other than the dimensional relationship between the width 66*g* of the projection and depression portion 66*c*1 of the mating portion and the width 66*h* of the mating portion at the end portion in the axial direction C of the charging roller 66.

Configuration of Charging Roller

The length of one of the widths 66*h* of the straight areas 66*c*3 at the mating portion in the axial direction C of the charging roller 66 is set to be longer than that of the width 66*g* of one of the projection and depression portion 66*c*4 in the axial direction C of the charging roller 66.

In this example, the width 66*h* of the straight areas 66*c*3 is set to 16 mm, and the width 66*g* of one of the projection and depression portion 66*c*4 is set to 10.5 mm.

The width 66*h* of the straight areas 66*c*3 may be set to 4 to 30 mm and the width 66*g* of one of the projection and depression portions 66*c*4 may be set to a desired value, smaller than the width 66*h* of the straight portions 66*c*3. A width 66*j* of the end portion 66*d* illustrated in FIG. 13C is preferably at least on the order of 4 mm in order to secure the width of sliding movement with respect to the bearings 67L and 67R in the case where this part is used for manufacture or in terms of the product function. Therefore, the width 66*h* of the straight areas 66*c*3 is also preferable to be at least 4 mm.

The projection and depression area 66*c*1 of the mating portion is inclined at the angle F with respect to the direction D perpendicular to the axial direction C of the shaft portion 66*a* at engaging portions between the depressions and the projections. In other words, the depressions which constitute part of the projection and depression area 66*c*1 are depressed obliquely in the direction D by the angle F and a width of the depression on the bottom side (the length in the direction C) is smaller than the width of the depression on the opening side. In the same manner, the projections which constitute part of the projection and depression area 66*c*1 project obliquely in the direction D by the angle F.

It is because the depressions and the projections can easily be mated with the presence of the angle F (>0°). In this example, the value F is set to 3 degrees. However, a desired angle F between 0 and 10 may be selected ($0° < F \leq 10°$).

The outer diameter of the shaft portion 66*a* is ϕ6 mm, an inner diameter is ϕ4.8 mm. However, the outer diameter may be set as desired between 3 to 15 mm, and the inner diameter may be set as desired in a range obtained by subtracting a thickness (0.3 to 2 mm) of the metallic plate 66*a*1 from the outer diameter. The inner diameter of the shaft portion 66*a* does not have to be a circular shape if it is not required in terms of function of the product and manufacture.

In the process of bending the metallic plate 66*k*, for example, the projections and depressions may be formed inside (inner peripheral side) of the shaft portion 66*a*. Alternatively, a space does not have to be formed in the interior of the shaft portion 66*a*. For example, if an attempt is made to reduce the diameter of the shaft portion 66*a* with respect to the thickness of the metallic plate 66*k*, an internal space of the shaft portion 66*a* may substantially disappeared if the metallic plate 66*k* is bent to form the shaft portion 66*a*. Alternatively, filling the internal space of the shaft portion 66*a* by filling the interior of the shaft portion 66*a* with a reinforcing member in order to improve the strength of the shaft portion 66*a* is also conceivable.

In other words, in this application, if the shaft portion 66*a* has a cylindrical shape, it does not necessarily means that a space is formed in the interior of the shaft portion 66*a*, or a cross section of the internal space of the shaft portion 66*a* has a circular shape.

The projecting amount (=depressing amount) E of the projection and depression portion 66*c*1 and the projecting amount F of the straight portion 66*c*3 are the same in dimensional relationship and the value E is 2 mm, and the value F is 1 mm (not illustrated).

A projecting corner R or a recessed corner R may be provided at the corner portions 66*c*2 as needed (the projecting corners of the projections and the recessed corners of the depressions may have a curved surface). Although a configuration having no gap in engagement of the projections and depressions at the mating portion 66*c* (projection and depression area 66*c*1) is preferable in terms of strength, a gap may be partly generated.

By setting the width 66*h* of the straight areas 66*c*3 to be larger than the width 66*g* of the projection and depression portion 66*c*4 in this manner, the length of the end portion 66*d* may be increased, so that a wide (long in the axial direction C) sliding portion with respect to the bearing may be secured.

In Examples 1 to 3 described above, an example in which the charging roller of this disclosure is assembled to the process cartridge has been described. However, this disclosure is not limited thereto, and may the charging roller may be assembled to the image forming apparatus body in which a cartridge system is not employed. A configuration in which a minimum unit of only the charging roller can be mounted on and demounted from the process cartridge or the image forming apparatus body is also applicable.

In conclusion, summary of the advantageous effects of the Examples 1 to 3 disclosed in this application will be described below. In other words, according to the configuration disclosed in the respective examples, reducing the resistance at the metallic shaft and the bearing portion at the time of rotation of the roller member while increasing the strength of the metallic shaft is achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-074541 filed Mar. 31, 2014, which is hereby incorporated by reference herein in its entirety.

What is claimed is:

1. A roller member used in an image forming apparatus including a bearing portion comprising:

a metallic shaft; and a covering layer configured to cover the metallic shaft, wherein the metallic shaft has a cylindrical shape formed so that one end portion and the other end portion of a metallic plate oppose each other, the one end portion and the other end portion each include a straight portion, a projection, and a depression, the projection on the one end portion engages the depression on the other end portion, and the projection on the other end portion engages the depression on the one end portion in an opposing area in which the one end portion and the other end portion oppose each other, a straight area in which a straight portion on the one end portion and a straight portion on the other end portion oppose each other is located outside a projection and depression area in which the projection on the one end portion and the projection on the other end portion are aligned in an axial direction of the metallic shaft, and wherein all of corner potions of the projection and depression area are entirely covered with the covering layer, and wherein at least part of the straight area is positioned in an exposed portion which is a portion of an outer periphery surface of the metallic shaft and is exposed from the covering layer, the exposed portion contacting the bearing portion in a case where the exposed portion is used in the image forming apparatus.

2. The roller member according to claim 1, wherein the one end portion includes a plurality of the projections and the depressions, the other end portion includes a plurality of the projections and the depressions, and the projections on the one end portion and the projections on the other end portion are arranged alternately in the projection and depression area.

3. The roller member according to claim 2, wherein widths of the plurality of projections provided on the one end portion and on the other end portion measured in the axial direction are all the same.

4. The roller member according to claim 1, wherein a width of the straight portion is larger than the width of the projections on the one end portion and the width of the projections on the other end portion in the axial direction.

5. The roller member according to claim 1, wherein the depressions on the one end portion and the depressions on the other end portion are depressed obliquely with respect to a direction perpendicular to the axial direction, and the depressions have a width on a bottom side smaller than a width on an opening side in the axial direction.

6. The roller member according to claim 1, wherein the straight areas are provided on both end sides of the projection and depression area.

7. The roller member according to claim 1, wherein the roller member is a charging roller configured to charge an image bearing member configured to bear an image.

8. The roller member according to claim 1, wherein the roller member is a developing roller configured to bear developer for developing a latent image formed on the image bearing member.

9. A roller supporting mechanism used in an image forming apparatus comprising:

the roller member according to claim 1.

10. The roller supporting mechanism according to claim 9, wherein the roller supporting mechanism is capable of being mounted on and demounted from an apparatus body of the image forming apparatus as part of a cartridge.

11. The roller supporting mechanism according to claim 10, wherein the cartridge includes an image bearing member on which an image is formed.

12. A roller supporting mechanism used in an image forming apparatus comprising:

a roller member; and a bearing portion configured to support the roller member, wherein the roller member includes a metallic shaft and a covering layer configured to cover the metallic shaft, the metallic shaft has a cylindrical shape formed so that one end portion and the other end portion of a metallic plate oppose each other, the one end portion and the other end portion each includes a straight portion, a projection, and a depression, the projection on the one end portion engages the depression on the other end portion, and the projection on the other end portion engages the depression on the one end portion in an opposing area in which the one end portion and the other end portion oppose each other, a straight area in which a straight portion on the one end portion and a straight portion on the other end portion oppose each other is located outside a projection and depression area in which the projection on the one end portion and the projection on the other end portion are aligned in an axial direction of the metallic shaft, and wherein all of corner potions of the projection and depression area are entirely covered with the covering layer and the bearing portion is configured to support an exposed portion of an outer periphery surface of the metallic shaft exposed from the covering layer, and a contact portion of the exposed portion which comes into contact with the bearing portion is provided with the straight area and is not provided with the projection and depression area.

13. The roller supporting mechanism according to claim 12, wherein the one end portion includes a plurality of the projections and the depressions, the other end portion includes a plurality of the projections and the depressions, and the projections on the one end portion and the projections on the other end portions are arranged alternately in the projection and depression area.

14. The roller supporting mechanism according to claim 12, wherein widths of the plurality of projections provided on the one end portion and on the other end portion measured in the axial direction are all the same.

15. The roller supporting mechanism according to claim 12, wherein the straight areas are provided on both end sides of the projection and depression area.

16. The roller supporting mechanism according to claim 12, wherein a width of the straight portion is larger than the width of the projections on the one end portion and the width of the projections on the other end portion in the axial direction.

17. The roller supporting mechanism according to claim 12, wherein the depressions on the one end portion and the depressions on the other end portion are depressed obliquely with respect to a direction perpendicular to the axial direction, and the depressions have a width on a bottom side smaller than a width on an opening side in the axial direction.

18. The roller supporting mechanism according to claim 12, wherein the roller member is a charging roller configured to charge an image bearing member configured to bear an image.

19. The roller supporting mechanism according to claim 12, wherein the roller member is a developing roller configured to bear developer for developing a latent image formed on the image bearing member.

* * * * *